US008581127B2

(12) United States Patent
Jhuang et al.

(10) Patent No.: US 8,581,127 B2
(45) Date of Patent: Nov. 12, 2013

(54) KEY STRUCTURE WITH SCISSORS-TYPE CONNECTING MEMBER

(75) Inventors: Chuang-Shu Jhuang, Taipei (TW); Hsiang-Wen Cheng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 153 days.

(21) Appl. No.: 13/239,713

(22) Filed: Sep. 22, 2011

(65) Prior Publication Data

US 2012/0312670 A1 Dec. 13, 2012

(30) Foreign Application Priority Data

Jun. 10, 2011 (TW) ..... 100120321 A

(51) Int. Cl.
*H01H 9/00* (2006.01)

(52) U.S. Cl.
USPC ..... 200/314

(58) Field of Classification Search
USPC ..... 200/314, 5 R, 5 A, 46, 510–514, 520, 200/521, 308, 310, 311, 312, 313, 318.1, 200/337, 341, 343, 344, 345
See application file for complete search history.

(56) References Cited

U.S. PATENT DOCUMENTS

| | | | | |
|---|---|---|---|---|
| 5,152,392 | A * | 10/1992 | Iwasa | 200/517 |
| 6,860,612 | B2 * | 3/2005 | Chiang et al. | 362/29 |
| 7,670,017 | B2 * | 3/2010 | Tsai et al. | 362/23 |
| 8,093,519 | B2 * | 1/2012 | Liu et al. | 200/310 |
| 8,222,545 | B2 * | 7/2012 | Tsai | 200/5 A |
| 8,383,971 | B2 * | 2/2013 | Liu | 200/310 |
| 2010/0147662 | A1 * | 6/2010 | Yeh et al. | 200/314 |
| 2010/0252407 | A1 * | 10/2010 | Merminod et al. | 200/5 A |

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

A key structure includes a keycap, a scissors-type connecting element, a membrane module, a light-emitting element and a base plate. The light-emitting element is used for emitting light beams. The keycap has a protrusion structure for blocking the light beams and preventing the light beams from leaking out through the gap between said keycap and said base plate. The base plate has a slot corresponding to the protrusion structure. When the keycap is depressed, the membrane module is pressed by the protrusion structure to be subject to deformation, so that a deformed part of the membrane module is inserted into the slot of the base plate. In such way, the hand feel of depressing the keycap is not adversely affected.

10 Claims, 6 Drawing Sheets

KEY STRUCTURE WITH SCISSORS-TYPE CONNECTING MEMBER

FIELD OF THE INVENTION

The present invention relates to a key structure, and more particularly to a key structure of an illuminated keyboard.

BACKGROUND OF THE INVENTION

Generally, the common input device of a computer includes a mouse, a keyboard, a trackball, and the like. For example, via the keyboard, the user may directly input characters and symbols into the computer. Consequently, the users and the manufacturers of the input devices pay more attention to keyboards. With increasing development of science and technology, the keyboard manufacturers make efforts in designing novel keyboards with diversified functions. Recently, an illuminated keyboard with an illuminating function has been disclosed in order to meet the users' requirements.

Hereinafter, the outward appearance of a conventional illuminated keyboard will be illustrated with reference to FIG. 1. FIG. 1 is a schematic top view illustrating the outward appearance of a conventional illuminated keyboard. As shown in FIG. 1, a plurality of keys 10 are installed on the surface of the conventional illuminated keyboard 1. These keys 10 are classified into some types, e.g. ordinary keys, numeric keys and function keys. When one or more keys are depressed by a user, a corresponding signal is issued to the computer, and thus the computer executes a function corresponding to the depressed key or keys. For example, when an ordinary key is depressed, a corresponding English letter or symbol is inputted into the computer. When a numeric key is depressed, a corresponding number is inputted into the computer. In addition, the function keys (F1~F12) can be programmed to cause corresponding application programs to provide certain functions.

Hereinafter, the configurations and the functions of a conventional illuminated keyboard will be illustrated with reference to FIG. 2. Take one of the keys 10 for example. FIG. 2 is a schematic side view illustrating a key structure of a conventional illuminated keyboard. As shown in FIG. 2, the key structure 10 comprises a keycap 101, a scissors-type connecting member 102, an elastic element 103, a membrane switch circuit member 104, a base plate 105, a light-emitting element 106 and a light-shading plate 107. The keycap 101 may be touched and depressed by a user. The keycap 101 is connected with the scissors-type connecting member 102. The scissors-type connecting member 102 is arranged between the keycap 101 and the base plate 105. In addition, the scissors-type connecting member 102 is connected with the keycap 101 and the base plate 105. Through the scissors-type connecting member 102, the keycap 101 is movable upwardly or downwardly relative to the base plate 105. The membrane switch circuit member 104 is disposed on the base plate 105. The elastic element 103 is arranged between the keycap 101 and the membrane switch circuit member 104. When the keycap 101 is depressed, the elastic element 103 is deformed downwardly to trigger the membrane switch circuit member 104, so that the membrane switch circuit member 104 generates a key signal. The light-emitting element 106 is disposed under the keycap 101 for emitting light beams B. For example, the light-emitting element 106 is a light emitting diode (LED). The light-shading plate 107 is arranged between the keycap 101 and the membrane switch circuit member 104. In addition, the light-shading plate 107 is sustained against and supported by the scissors-type connecting member 102. The light-shading plate 107 has a light-shading region 1071 at the periphery thereof for sheltering the light beams B. For example, the light-shading plate 107 is made of Mylar. Moreover, by coating the periphery of the light-shading plate 107 with ink, the light-shading region 1071 is produced.

Please refer to FIG. 2 again. The light beams B emitted by the light-emitting element 106 are transmitted through the membrane switch circuit member 104, and directed to the keycap 101 and the gap between the keycap 101 and the membrane switch circuit member 104 so as to illuminate the key structure 10. In addition, the portions of the light beams B directed to the gap between the keycap 101 and the membrane switch circuit member 104 are sheltered by the light-shading region 1071 of the light-shading plate 107, so that the possibility of causing light leakage is minimized.

In a case that the key structure 10 is not depressed, as shown in FIG. 2, the keycap 101 of the key structure 10 is located at a first height (not shown). Whereas, when the key structure 10 is depressed, a depressing force is exerted on the keycap 101 to press against the elastic element 103, and thus the elastic element 103 is in a compressed state. As the keycap 101 is depressed, the scissors-type connecting member 102 is swung and changed to a folded state. At the same time, the elastic element 103 is deformed downwardly to trigger the membrane switch circuit member 104 overlying the base plate 105, so that the membrane switch circuit member 104 generates a key signal. In addition, the keycap 101 of the key structure 10 is lowered from the first height to a second height (not shown). When the keycap 101 is depressed to the end, the keycap 101 is moved downwardly to press against the light-shading plate 107, and thus the light-shading region 1071 of the light-shading plate 107 is contacted with the base plate 105. Under this circumstance, the gap between the keycap 101 and the base plate 105 is sheltered by the light-shading region 1071, and thus the light beams B fail to be transmitted through the light-shading region 1071 (see FIG. 3).

At the time when the depressing force exerted on the keycap 101 is eliminated, the keycap 101 will be moved upwardly is response to the restoring force of the elastic element 103. As the keycap 101 is moved upwardly, the scissors-type connecting member 102 responds to the traction of the keycap 101. Consequently, the keycap 101 is returned to its original position where the keycap 101 has not been depressed (i.e. at the first height).

Although the use of the light-shading plate 107 of the conventional illuminated keyboard 1 can prevent the light beams B from leaking to the region between any two adjacent keys 10, there are still some drawbacks. For example, since the keycap 101 is contacted with the light-shading plate 107 during the process of depressing the keycap 101, the hand feel of depressing the keycap 101 is usually unsatisfied. If the illuminated keyboard 1 has been used for a long term, the hand of the user is readily fatigued. Therefore, there is a need of providing a key structure for avoiding the light leakage problem and enhancing the hand feel.

SUMMARY OF THE INVENTION

The present invention provides a key structure of an illuminated keyboard in order to avoid the light leakage problem and enhance the hand feel.

In accordance with an aspect of the present invention, there is provided a key structure with a scissors-type connecting member. The key structure includes a base plate, a keycap, the scissors-type connecting element and a light-emitting element. The keycap has a light-transmissible region and an extension sidewall. The light-transmissible region is located at a surface of the keycap. The extension sidewall is located at a periphery of the keycap. In addition, a protrusion structure located at a first side and a second side of the extension sidewall. The scissors-type connecting element is arranged between the base plate and the keycap for connecting the base plate and the keycap, and allowing the keycap to be moved upwardly and downwardly relative to the base plate. The light-emitting element is disposed under the keycap for emitting light beams. When the light beams are directed to the keycap, first portions of the light beams are transmitted through the light-transmissible region to illuminate the keycap, and second portions of the light beams are blocked by the protrusion structure to avoid light leakage.

In an embodiment, the protrusion structure is located at a first side and a second side of the extension sidewall, wherein the first side of the extension sidewall is located adjacent to the second side of the extension sidewall, so that the protrusion structure is an L-shaped structure. The protrusion structure and the extension sidewall are integrally formed with the keycap.

In an embodiment, an included angle is defined between the extension sidewall and the surface of the keycap, the protrusion structure is protruded from the extension sidewall, and the protrusion structure is perpendicular to the surface of the keycap.

In an embodiment, the key structure further includes a membrane module, which is arranged between the keycap and the base plate. The membrane module includes a membrane switch circuit member and an elastic element film layer. The membrane switch circuit member is disposed on the base plate. When the membrane switch circuit member is triggered, the membrane switch circuit member generates a key signal. The elastic element film layer is disposed on the membrane switch circuit member.

In an embodiment, the key structure further includes an elastic element, which is disposed on the elastic element film layer. A lower portion of the elastic element is in contact with the elastic element film layer. The elastic element is penetrated through the scissors-type connecting member. An upper portion of the elastic element is in contact with the keycap. When the elastic element is pushed by the keycap, the membrane switch circuit is triggered by the elastic element. Whereas, when a depressing force exerted on the keycap is eliminated, an elastic force is provided to the keycap by the elastic element.

In an embodiment, the base plate has a slot corresponding to the protrusion structure. When the keycap is moved downwardly relative to the base plate, the membrane module is pressed by the protrusion structure to be subject to deformation, so that a deformed part of the membrane module is inserted into the slot of the base plate.

In an embodiment, the membrane switch circuit member includes an upper wiring board, a partition plate and a lower wiring board. The upper wiring board has a plurality of upper contacts. The partition plate is disposed under the upper wiring board, and having a plurality of partition plate openings corresponding to the upper contacts. When the membrane switch circuit member is depressed, a corresponding upper contact is inserted into a corresponding partition plate opening The lower wiring board is disposed under the partition plate, and has a plurality of lower contacts corresponding to the upper contacts. The plurality of lower contacts and the plurality of upper contacts are collectively defined as a plurality of key intersections.

In an embodiment, the light-emitting element is disposed on the upper wiring board of the membrane switch circuit member, wherein the light-emitting element is a light emitting diode (LED).

In an embodiment, the elastic element film layer includes a light shade for enclosing the light-emitting element, thereby partially sheltering the light beams. The light shade has a light shade perforation disposed under the light-transmissible region. The light beams are transmitted through the light shade perforation and directed to the light-transmissible region.

In an embodiment, the light shade is formed by mold-punching or mold-compressing the elastic element film layer.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
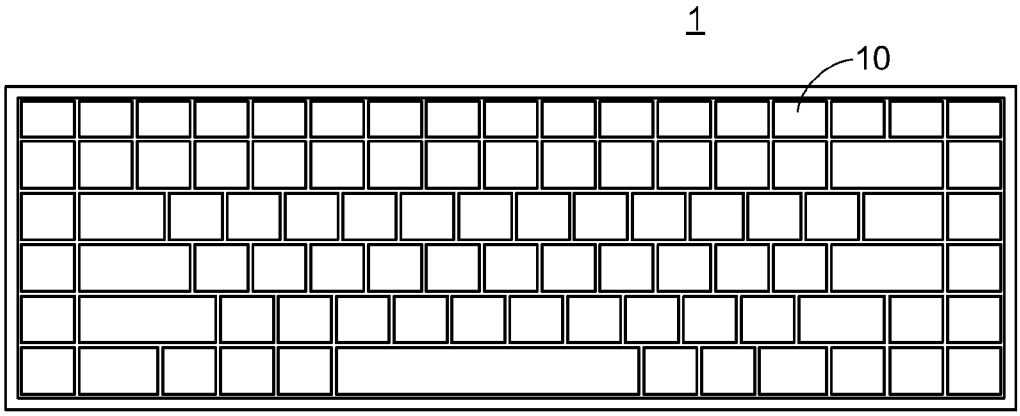
FIG.1 PRIOR ART
FIG. 1 is a schematic top view illustrating the outward appearance of a conventional illuminated keyboard.
Figure 2:
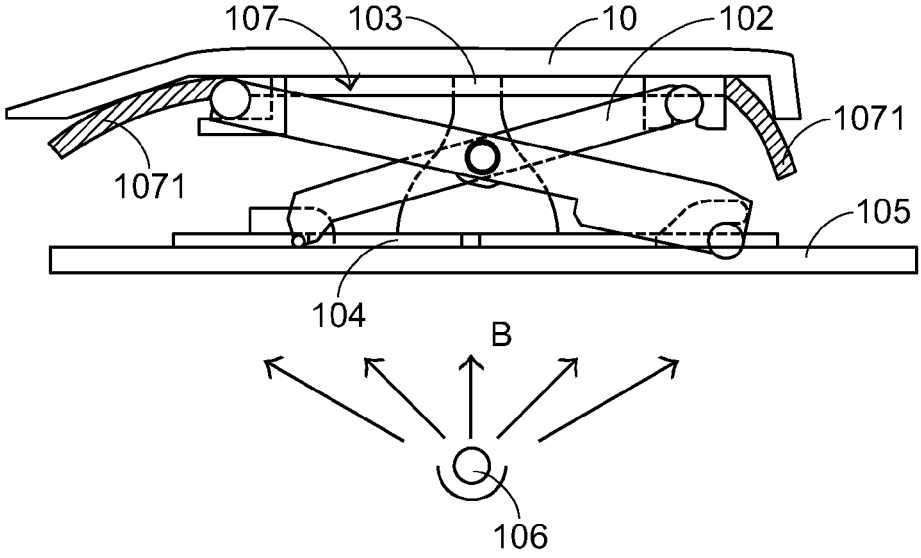
FIG.2 PRIOR ART
FIG. 2 is a schematic side view illustrating a key structure of a conventional illuminated keyboard.
Figure 3:
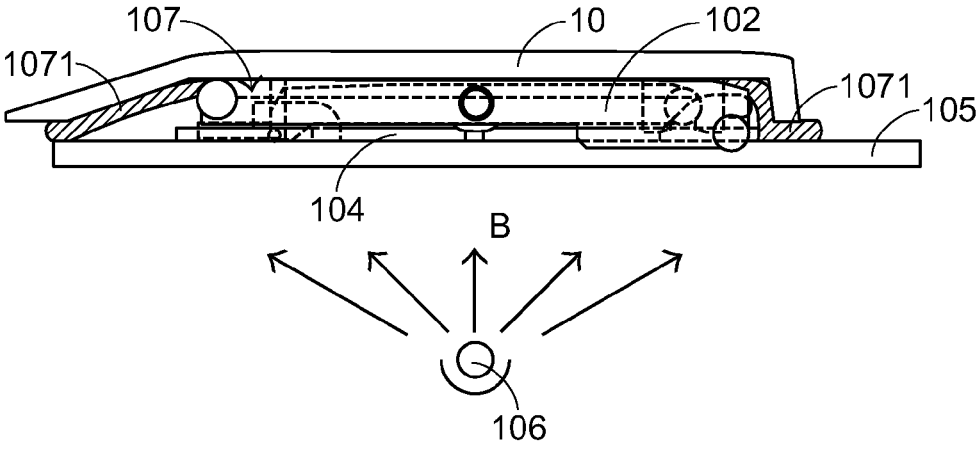
FIG.3 PRIOR ART
FIG. 3 is a schematic side view illustrating the key structure of the illuminated keyboard of FIG. 2, in which the key structure is depressed.
Figure 4:
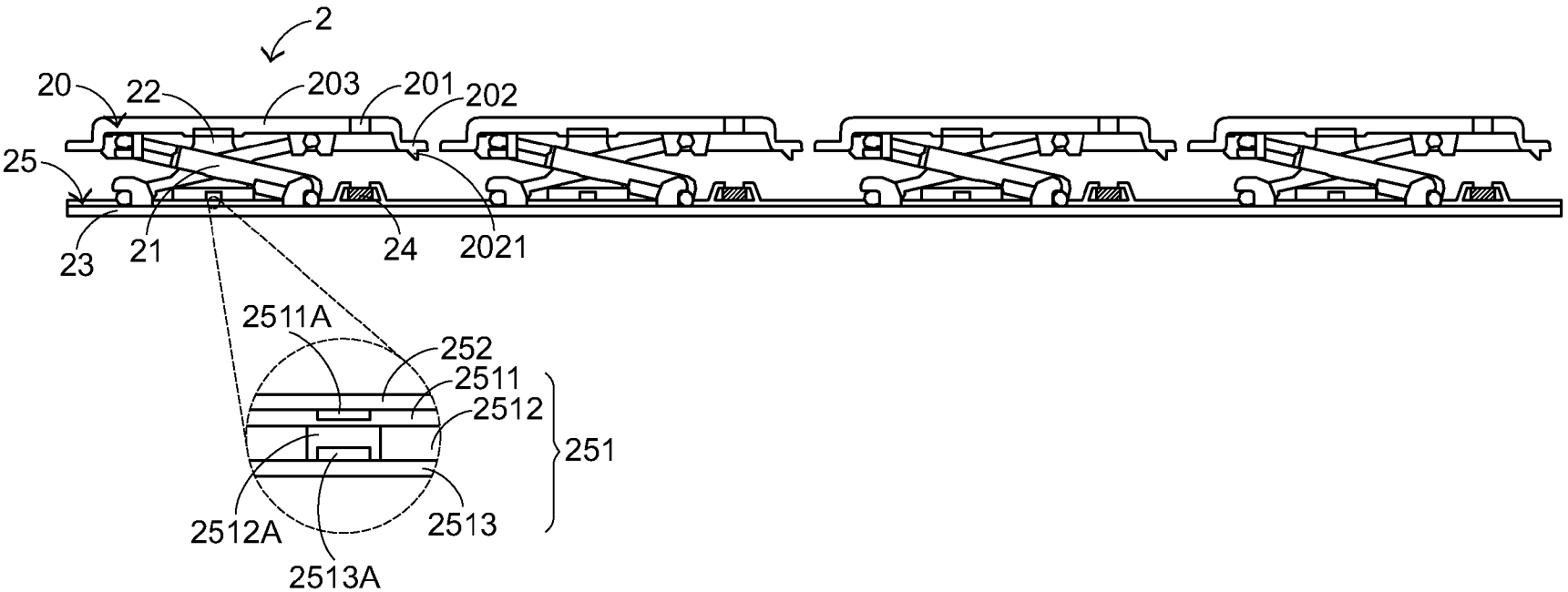
FIG. 4 is a schematic partial side view illustrating an illuminated keyboard according to an embodiment of the present invention.

For obviating the drawbacks encountered from the prior art, the present invention provides a key structure with a scissors-type connecting member. FIG. 4 is a schematic partial side view illustrating an illuminated keyboard according to an embodiment of the present invention. The illuminated keyboard 2 comprises a plurality of key structures. Each of the key structures comprises a keycap 20, a scissors-type connecting member 21, an elastic element 22, a base plate 23, a light-emitting element 24 and a membrane module 25. The membrane module 25 comprises a membrane switch circuit member 251 and an elastic element film layer 252. From top to bottom, the keycap 20, the scissors-type connecting member 21, the elastic element 22, the elastic element film layer 252, the light-emitting element 24, the membrane switch circuit member 251 and the base plate 23 of the illuminated keyboard 2 are sequentially shown.

Figure 5:
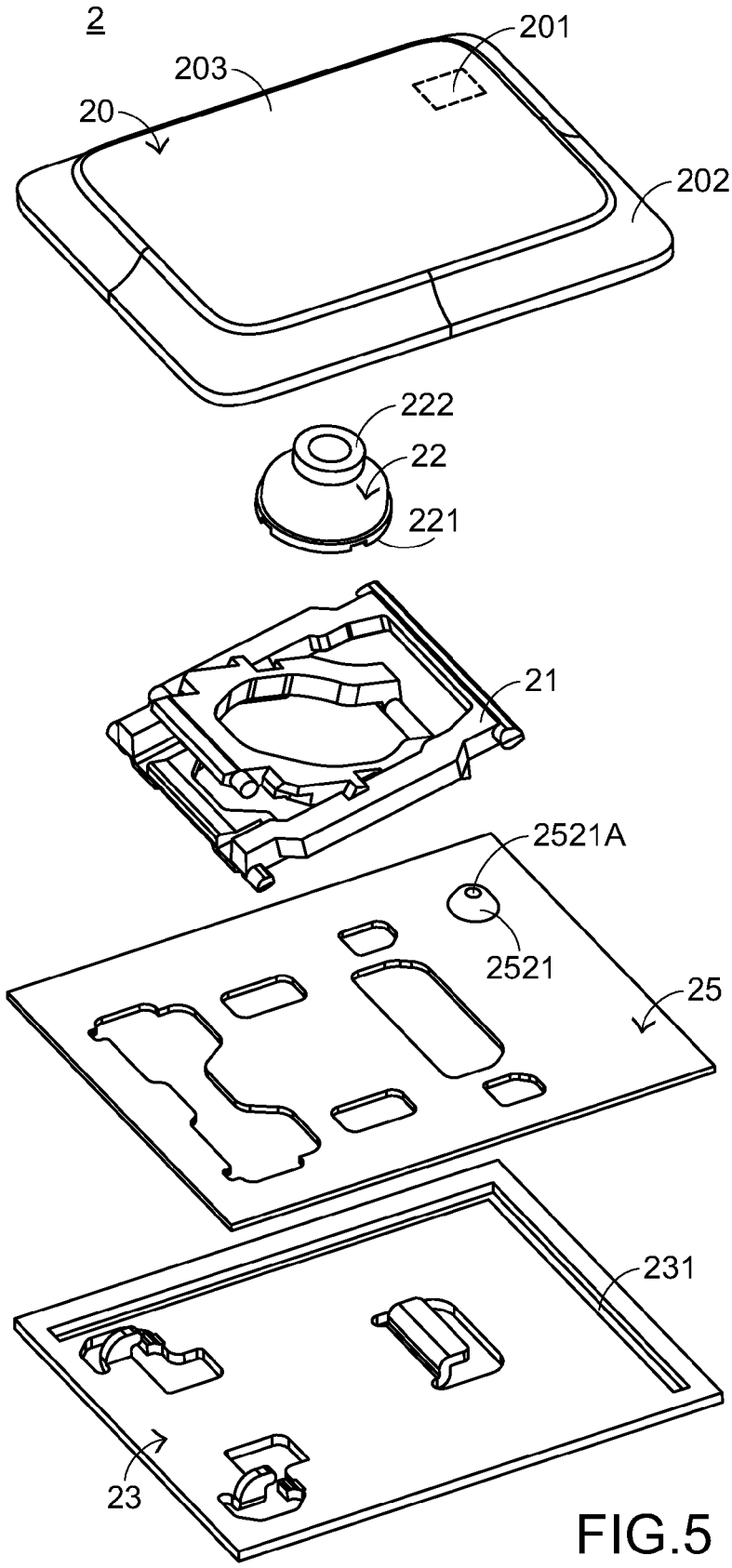
FIG. 5 is a schematic exploded view illustrating a key structure with a scissors-type connecting member according to an embodiment of the present invention.
Figure 6:
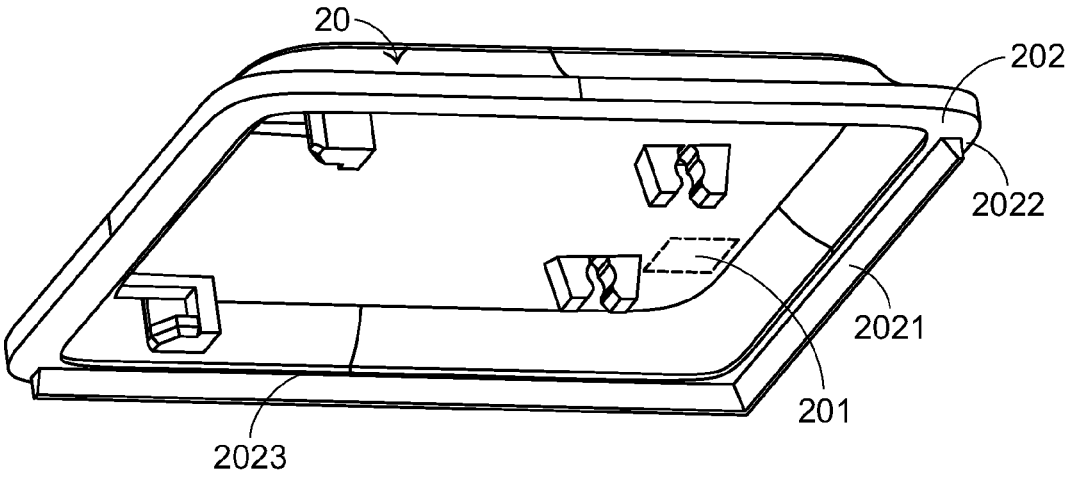
FIG. 6 is a schematic perspective view illustrating the keycap of the key structure according to an embodiment of the present invention.

For clarification, a single key structure will be illustrated as follows. FIG. 5 is a schematic exploded view illustrating a key structure with a scissors-type connecting member according to an embodiment of the present invention. FIG. 6 is a schematic perspective view illustrating the keycap of the key structure according to an embodiment of the present invention. Please refer to FIGS. 5 and 6. The keycap 20 has a light-transmissible region 201 and an extension sidewall 202. The light-transmissible region 201 is located at a surface 203 of the keycap 20. In this embodiment, the light-transmissible region 201 is located at a character region or a symbol region of the keycap 20. The light beams B* emitted by the light-emitting element 24 can be transmitted through the light-transmissible region 201, thereby illuminating the character or symbol shown on the keycap 20. The extension sidewall 202 is located at the periphery of the keycap 20. In addition, an included angle A is defined between the extension sidewall 202 and the surface 203 of the keycap 20 (see FIG. 7). A protrusion structure 2021 is formed on the extension sidewall 202. In this embodiment, the protrusion structure 2021 is located at a first side 2022 and a second side 2023 of the extension sidewall 202. As shown in FIG. 6, the first side 2022 of the extension sidewall 202 is located adjacent to the second side 2023 of the extension sidewall 202. Consequently, the protrusion structure 2021 is an L-shaped structure protruded from the keycap 20. It is preferred that the protrusion structure 2021 and the extension sidewall 202 are integrally formed with the keycap 20. That is, the protrusion structure 2021 is protruded from the extension sidewall 202. Moreover, the protrusion structure 2021 is perpendicular to the surface 203 of the keycap 20. As shown in FIG. 5, the base plate 23 has a slot 231 corresponding to the protrusion structure 2021. That is, the slot 231 is an L-shaped slot mating with the protrusion structure 2021.

Figure 7:
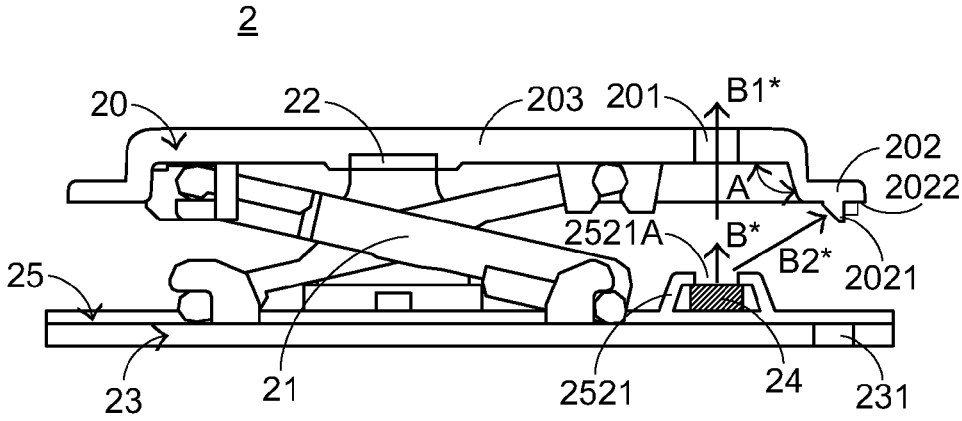
FIG. 7 is a schematic side view illustrating a key structure of an illuminated keyboard according to an embodiment of the present invention.

Please refer to FIGS. 5 and 7. FIG. 7 is a schematic side view illustrating a key structure of an illuminated keyboard according to an embodiment of the present invention. As shown in FIG. 7, the scissors-type connecting member 21 is arranged between the base plate 23 and the keycap 20. In addition, the scissors-type connecting member 21 is connected with the base plate 23 and the keycap 20. Through the scissors-type connecting member 21, the keycap 20 is movable upwardly or downwardly relative to the base plate 23. The elastic element 22 is disposed on the elastic element film layer 252. In addition, a lower portion 221 of the elastic element 22 is in contact with the elastic element film layer 252. The elastic element 22 is penetrated through the scissors-type connecting member 21, and an upper portion 222 of the elastic element 22 is in contact with the keycap 20. When the keycap 20 is depressed, the keycap 20 is moved downwardly to push against the elastic element 22, and thus the membrane switch circuit member 251 is triggered by the elastic element 22 to generate a key signal. Whereas, when the depressing force exerted on the keycap 20 is eliminated, an elastic force provided by the elastic element 22 is acted on the keycap 20.

The membrane switch circuit member 251 of the membrane module 25 is disposed on the base plate 23. When the membrane switch circuit member 251 is triggered, the membrane switch circuit member 251 generates a key signal. In this embodiment, the membrane switch circuit member 251 comprises an upper wiring board 2511, a partition plate 2512 and a lower wiring board 2513 (see FIG. 4). The upper wiring board 2511, the partition plate 2512 and the lower wiring board 2513 are all made of transparent material. The transparent material includes for example polycarbonate (PC) or polyethylene (PE). The upper wiring board 2511 has a plurality of upper contacts 2511A. The partition plate 2512 is disposed under the upper wiring board 2511, and comprises a plurality of partition plate openings 2512A corresponding to the upper contacts 2511A. The lower wiring board 2513 is disposed under the partition plate 2512, and comprises a plurality of lower contacts 2513A corresponding to the upper contacts 2511A. The lower contacts 2513A and the upper contacts 2511A are collectively defined as a plurality of key intersections. When one of the key intersections is triggered, a corresponding key signal is generated. The light-emitting element 24 is disposed under the keycap 20 and over the upper wiring board 2511 of the membrane switch circuit member 251 for emitting the light beams B*. In this embodiment, the light-emitting element 24 is a light emitting diode (LED).

The elastic element film layer 252 is disposed on the membrane switch circuit member 251 for fixing the elastic element 22 thereon and preventing detachment of the elastic element 22. Moreover, the elastic element film layer 252 comprises a light shade 2521 for enclosing the light-emitting element 24, thereby partially sheltering the light beams B*. The light shade 2521 has a light shade perforation 2521A, which is disposed under the light-transmissible region 201 of the keycap 20. The light beams B* may be transmitted through the light shade perforation 2521A, and directed to the light-transmissible region 201. In this embodiment, the light shade 2521 is formed by mold-punching or mold-compressing the elastic element film layer 252.

Hereinafter, the operations of the key structure 2 with the scissors-type connecting member will be illustrated with reference to FIG. 7. After the light beams B* are emitted by the light-emitting element 24, the light beams B* are sheltered by the light shade 2521, so that the light beams B* are only permitted to pass through the light shade perforation 2521A of the light shade 2521. The first portions B1* of the light beams B* passing through the light shade perforation 2521A are transmitted through the light-transmissible region 201 to illuminate the keycap 20. Whereas, second portions B2* of the light beams B* passing through the light shade perforation 2521A are directed to the gap between the keycap 20 and the base plate 23. Since the second portions B2* of the light beams B* is blocked by the protrusion structure 2021 of the keycap 20, the second portions B2* of the light beams B* fail to leak out through the gap between the keycap 20 and the base plate 23. That is, the use of the protrusion structure 2021 can prevent the second portions B2* of the light beams B* from leaking to the region between any two adjacent keycaps 20. Consequently, the illuminating efficacy of the key structure 2 is centralized at the light-transmissible region 201.

Figure 8:
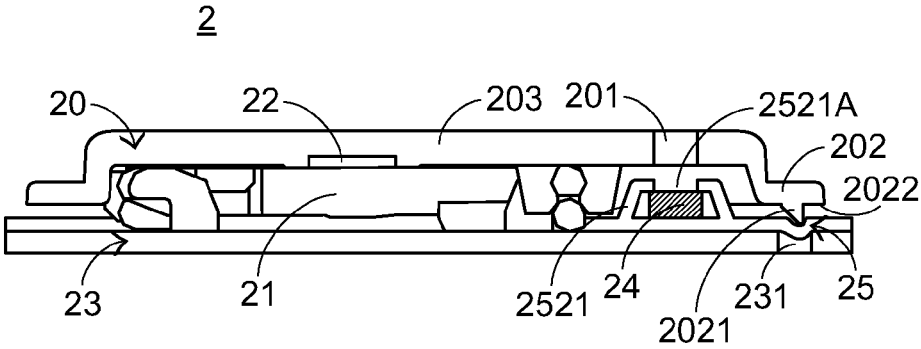
FIG. 8 is a schematic side view illustrating the key structure of the illuminated keyboard of FIG. 7, in which the key structure is depressed.

FIG. 8 is a schematic side view illustrating the key structure of the illuminated keyboard of FIG. 7, in which the key structure is depressed. When the keycap 20 is depressed by a user, the keycap 20 is moved downwardly relative to the base plate 23. At the same time, the elastic element 22 is compressed to push against the membrane switch circuit member 251, so that the upper contact 2511A of the upper wiring board 2511 is inserted into a corresponding partition plate opening 2512A to be contacted with a corresponding lower contact 2513A. Under this circumstance, a corresponding key intersection of the membrane switch circuit module 251 is triggered to generate a key signal. As the keycap 20 is moved downwardly, the protrusion structure 2021 of the keycap 20 is contacted with and pressed against the membrane module 25. Under this circumstance, the membrane module 25 is subject to deformation. Since the deformed part of the membrane module 25 is inserted into the slot 231 of the base plate 23, the interference between the keycap 20 and the membrane module 25 is reduced without influencing the signal transmission of the membrane switch circuit member 251. Whereas, when the depressing force exerted on the keycap 20 is eliminated, an elastic force provided by the elastic element 22 is acted on the keycap 20. Due to the elastic force, the keycap 20 is returned to its original position where the keycap 20 has not been depressed.

From the above description, the key structure with a scissors-type connecting member according to the present invention has a protrusion structure on the keycap. The use of the protrusion structure can block the light beams and further avoid light leakage. When the keycap is depressed, the protrusion structure of the keycap is pressed against the membrane module, so that the membrane module is subject to deformation. Since the base plate has a slot aligned with the protrusion structure of the keycap, the deformed part of the membrane module is inserted into the slot of the base plate without influencing the signal transmission of the membrane switch circuit member. In other words, since the interference between the keycap and the membrane module is reduced, the hand feel of depressing the keycap is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure with a scissors-type connecting member, said key structure comprising:

a base plate;

a keycap having a light-transmissible region and an extension sidewall, wherein said light-transmissible region is located at a surface of said keycap, said extension sidewall is located at a periphery of said keycap, and a protrusion structure located at a first side and a second side of said extension sidewall and extending downward beyond a bottom of said extension side wall;

said scissors-type connecting element arranged between said base plate and said keycap for connecting said base plate and said keycap, and allowing said keycap to be moved upwardly and downwardly relative to said base plate; and a light-emitting element disposed under said keycap for emitting light beams, wherein when said light beams are directed to said keycap, first portions of said light beams are transmitted through said light-transmissible region to illuminate said keycap, and second portions of said light beams are blocked by said protrusion structure to avoid light leakage.

2. The key structure according to claim 1 wherein said protrusion structure extends from said first side to said second side of said extension sidewall, wherein said first side of said extension sidewall is located adjacent to said second side of said extension sidewall, so that said protrusion structure is an L-shaped structure, wherein said protrusion structure and said extension sidewall are integrally formed.

3. The key structure according to claim 2 wherein an included angle is defined between said extension sidewall and said surface of said keycap, said protrusion structure is protruded from said extension sidewall, and said protrusion structure is perpendicular to said surface of said keycap.

4. The key structure according to claim 1 further comprising a membrane module, which is arranged between said keycap and said base plate, wherein said membrane module comprises:

a membrane switch circuit member disposed on said base plate, wherein when said membrane switch circuit member is triggered, said membrane switch circuit member generates a key signal; and an elastic element film layer disposed on said membrane switch circuit member.

5. The key structure according to claim 4 further comprising an elastic element, which is disposed on said elastic element film layer, wherein a lower portion of said elastic element is in contact with said elastic element film layer, said elastic element is penetrated through said scissors-type connecting member, and an upper portion of said elastic element is in contact with said keycap, wherein when said elastic element is pushed by said keycap, said membrane switch circuit is triggered by said elastic element, wherein when a depressing force exerted on said keycap is eliminated, an elastic force is provided to said keycap by said elastic element.

6. The key structure according to claim 4 wherein said base plate has a slot corresponding to said protrusion structure, wherein when said keycap is moved downwardly relative to said base plate, said membrane module is pressed by said protrusion structure to be subject to deformation, so that a deformed part of said membrane module is inserted into said slot of said base plate.

7. The key structure according to claim 4 wherein said membrane switch circuit member comprises:

an upper wiring board having a plurality of upper contacts;

a partition plate disposed under said upper wiring board, and having a plurality of partition plate openings corresponding to said upper contacts, wherein when said membrane switch circuit member is depressed, a corresponding upper contact is inserted into a corresponding partition plate opening; and a lower wiring board disposed under said partition plate, and having a plurality of lower contacts corresponding to said upper contacts, wherein said plurality of lower contacts and said plurality of upper contacts are collectively defined as a plurality of key intersections.

8. The key structure according to claim 7 wherein said light-emitting element is disposed on said upper wiring board of said membrane switch circuit member, wherein said light-emitting element is a light emitting diode (LED).

9. The key structure according to claim 4 wherein said elastic element film layer comprises a light shade for enclosing said light-emitting element, thereby partially sheltering said light beams, wherein said light shade has a light shade perforation disposed under said light-transmissible region, wherein said light beams are transmitted through said light shade perforation and directed to said light-transmissible region.

10. The key structure according to claim 9 wherein said light shade is formed by mold-punching or mold-compressing said elastic element film layer.

* * * * *